US006436881B1

(12) United States Patent
McHenry et al.

(10) Patent No.: US 6,436,881 B1
(45) Date of Patent: Aug. 20, 2002

(54) HIGH TEMPERATURE LUBRICANT COMPOSITION

(75) Inventors: Michael A. McHenry, Washington; Dale D. Carr, Morristown; Jeffrey A. Hutter, Hillside, all of NJ (US)

(73) Assignee: Hatco Corporation, Fords, NJ (US)

( * ) Notice: Subject to any disclaimer, the term of this patent is extended or adjusted under 35 U.S.C. 154(b) by 0 days.

(21) Appl. No.: 09/872,191

(22) Filed: Jun. 1, 2001

(51) Int. Cl.[7] ..... C10M 141/02

(52) U.S. Cl. ..... 508/280; 508/279; 508/474; 508/485

(58) Field of Search ..... 508/280, 279, 508/474, 485

(56) References Cited

U.S. PATENT DOCUMENTS 4,826,633 A * 5/1989 Carr et al. ..... 508/485
5,503,761 A * 4/1996 Ashcraft, Jr. et al. ..... 508/485
5,681,800 A * 10/1997 Duncan et al. ..... 508/485
5,767,047 A * 6/1998 Duncan et al. ..... 508/485
5,817,607 A * 10/1998 Duncan et al. ..... 508/485
5,853,609 A * 12/1998 Schnur et al. ..... 508/485
5,895,778 A * 4/1999 McHenry et al. ..... 508/485
5,906,769 A * 5/1999 Schnur et al. ..... 508/485
6,177,387 B1 * 1/2001 Schlosberg et al. ..... 508/485
6,221,272 B1 * 4/2001 Schnur et al. ..... 508/485

* cited by examiner

*Primary Examiner*—Jacqueline V. Howard
(74) *Attorney, Agent, or Firm*—Cowan, Liebowitz & Latman, P.C.; Michael I. Wolfson

(57) ABSTRACT

Improved synthetic lubricants based on a 100% polyol ester composition suitable for use in high temperature static chain oil applications is provided. The lubricant includes a base stock based on a polyol ester that is the reaction product of a neopentyl polyol including a major proportion of dipentaerythritol and a mixture of $C_5$ to $C_{12}$ carboxylic acids. The preferred carboxylic acid mixture includes heptanoic ($C_7$) acid, caprylic/capric ($C_{8-10}$) acid and isononanoic (3, 5, 5-trimethylhyxanoic acid (iso-$C_9$). The polyol base stock is mixed with an additive package that includes a viscosity index improver (tackifier), antioxidants, extreme pressure/antiwear agents and a corrosion inhibitor. The additive package may be added in up to about 20 percent by weight of the lubricant to provide a viscosity of the lubricant at 40° C. of at least about 275 cSt and at 100° C. of no less than about 25.0 cSt.

13 Claims, 1 Drawing Sheet

Panel Coking @ 282°C for 20 hours

Example 2

Example 4
Sample B

Panel Coking @ 282°C for 20 hours

Example 2

Example 4
Sample B

HIGH TEMPERATURE LUBRICANT COMPOSITION

BACKGROUND OF THE INVENTION

This invention relates generally to lubricant compositions capable of operating at high temperatures and, more particularly to a polyol ester lubricant composition suitable for use as a chain and drive gear lubricant operating at temperatures in excess of 250° C.

There are continuing demands for lubricant compositions suitable to operate at high temperature in excess of 250° C. Such lubricants must provide lubrication and antiwear protection. In addition, they must be stable in the high temperature environment, or decompose harmlessly without forming hard, varnish-like deposits or unacceptable amounts of smoke. Many industrial processes involve operation of open chain and drive gear assemblies that are associated with ovens, furnaces, kilns and other hot equipment. Such chain and drive gear assemblies are used in the manufacture of textiles, wallboard, corrugated metal, paper and plastic film.

In addition to not forming deposits or varnish and possessing stability at high temperatures, the lubricants must perform under high load, be compatible with all materials in contact with the lubricant and be low in volatility. Existing commercial lubricants for chain and drive gear operations, which are based on vegetable oils or other glycerol-based esters and mineral oil, lack sufficient high-temperature stability. Polyolefins or polyacid esters also lack the necessary high-temperature stability. All these lubricants are prone to varnish formation and are characterized by relatively high volatility, as well as severe compatibility problems with silicone elastomers.

In industrial chain and drive gear assemblies operating in a static mode, spent lubricant collects and remains in pools under high temperature conditions. This causes the lubricants to form varnish-like deposits that are highly undesirable. Such deposits often lead to equipment failure, increased down time and higher maintenance costs. Varnish formation results primarily from thermal and oxidative degradation as well as by excessive evaporation.

One such high temperature chain and drive gear lubricant is described in U.S. Pat. No. 5,151,205 to Calpon, Jr. While the Calpon patent describes a wide variety of synthetic polyalphaolefin based oils and ester based oils, the described compositions include a polyalphaolefin base oil, an ester oil solubulizer and 2–4 weight % of a polybutene tackifier. The composition is promoted for reducing smoking in chain and drive gear assemblies operated at high temperatures. However, as shown in comparative testing below such lubricants based on these polyalphaolefins tend to evaporate under high temperature exposure and are not fully satisfactory. Presently, no 100% polyol ester based chain lubricants are fully satisfactory in this respect.

Accordingly, it is highly desirable to provide high temperature lubricants suitable for use in high temperature chain oil environments that exhibit reduced evaporation rates under high temperature conditions and avoid the varnish/deposits shortcomings of the commercially available chain oil lubricants.

SUMMARY OF THE INVENTION

Generally speaking, in accordance with the invention, improved synthetic lubricants based on a 100% polyol ester composition suitable for use in high temperature static chain oil applications is provided. The lubricant includes a base stock based on a polyol ester that is the reaction product of a neopentyl polyol including a major proportion of dipentaerythritol and a mixture of $C_5$ to $C_{12}$ carboxylic acids. The preferred acid mixtures include heptanoic ($C_7$) acid, caprylic/capric ($C_{8-10}$) acid and isononanoic (3, 5, 5-trimethylhexanoic) acids (iso-$C_9$). The polyol ester composition should have a molecular weight average of at least about 750. It includes a major proportion of polyol esters with neoalkoxy structural elements, specifically with no beta hydrogen on the polyol moiety that precludes thermal degradation to an olefin and carboxylic acid. The viscosity of the polyol ester should be at least about 100 to 125 cSt at 40° C.

The polyol ester base stock is mixed with viscosity index improver (tackifer) and an additive package that includes antioxidants, extreme pressure/anti-wear agents and a corrosion inhibitor. The additive package may be added in up to about 20 percent by weight of the lubricant to provide a viscosity of the lubricant at 40° C. of at least about 275 cSt and at 100° C. of no less than about 25.0 cSt. When placed in a circulating air oven at 230° C. for 80 hours, the formulated lubricant will have a percent weight loss less than about 20 weight %.

Accordingly, it is an object of the invention to provide a synthetic ester lubricant suitable for use in high temperature chain oil applications.

Another object of the invention is to provide an improved synthetic ester lubricant including a major proportion of polyol esters lacking a beta hydrogen suitable for use in high temperature chain oil applications.

A further object of the invention is to provide an improved polyol ester lubricant including a viscosity index improver (tackifer) and an additive package that includes antioxidants extreme pressure/anti-wear agents and corrosion inhibitors.

Yet another object of the invention is to provide an improved high temperature polyol ester synthetic lubricant including a major proportion of dipentaerythritol esters and an additive package that has reduced weight loss when subject to heat for extended periods of time.

Still another object of the invention is to provide an improved polyol ester lubricant for high temperature application that does not form hard varnish and undesirable deposits when subject to high temperature.

Still other objects and advantages of the invention will in part be obvious and will in part be apparent from the specification.

The invention accordingly comprises a composition of matter possessing the characteristics, properties and the relation of components that will be exemplified in the compositions hereinafter described, and the scope of the invention will be indicated in the claims.

BRIEF DESCRIPTION OF THE DRAWINGS

For a fuller understanding of the invention, reference is had to the following description taken in connection with the accompanying drawing(s), in which.

DESCRIPTION OF PREFERRED EMBODIMENTS

Figure 1:
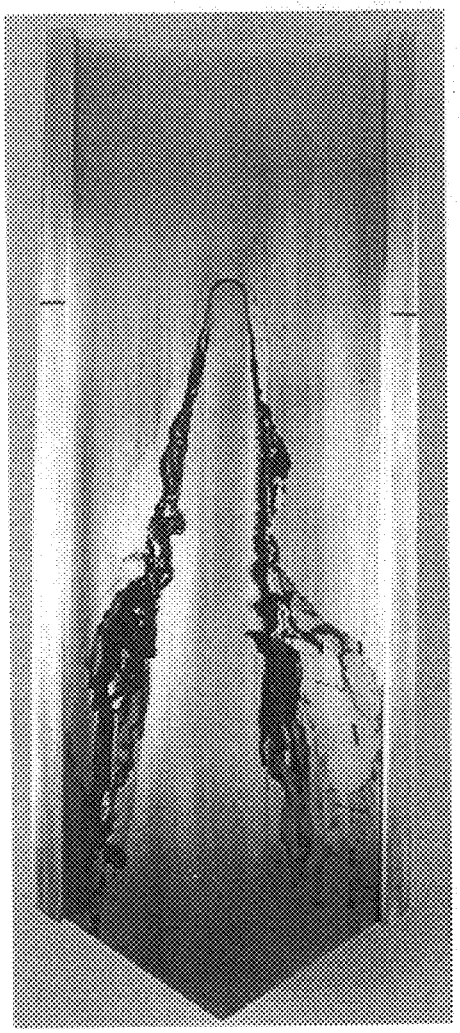
FIG. 1 is a photograph of panel coking tests for a polyol ester based lubricant in accordance with the invention and a polyalphaolefin based lubricant formulated in accordance with the prior art.
Figure 1:
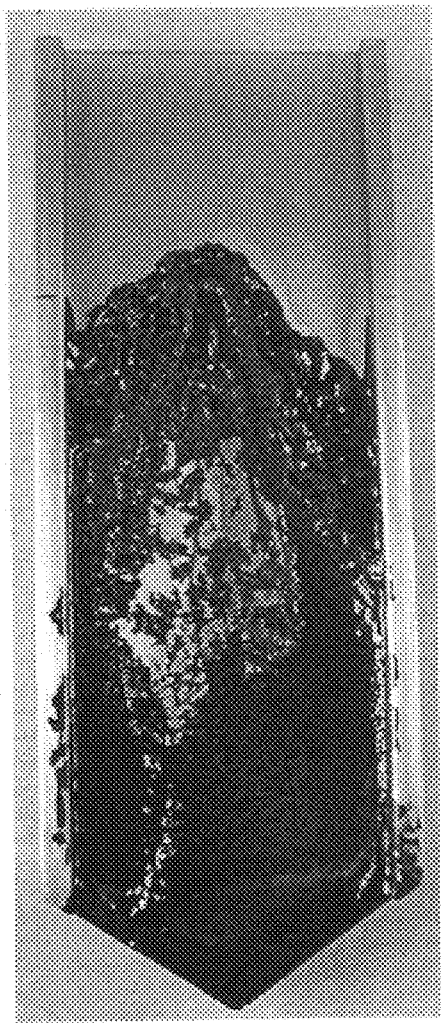

The base stock suitable for use in the high temperature chain oil lubricant applications in accordance with the invention is based on a 100% polyol ester. The polyol ester is the reaction product of a dipentaerythritol polyol and a mixture of $C_5$–$C_{12}$ monocarboxylic acids.

Specifically, a preferred synthetic polyol ester base stock is the reaction product of:

(a) a polyol mixture including a major proportion of dipentaerythritol, and (b) a mixture of $C_7$ to $C_{10}$ carboxylic acids, said mixture including:

(1) from about 25–50 weight percent of linear $C_7$ to $C_{8-10}$ acids, and (2) from about 50–75 weight percent iso-$C_9$ acid;

wherein the resulting mixture of esters has a viscosity at 40° C. of at least about 120 cSt.

Various additives are added to the synthetic polyol ester base stock to form the lubricant composition. Depending on the viscosity of the polyol ester base stock between about 3–8 parts by weight of a viscosity index improver may be added to increase the viscosity of the composition to between about 240 to 300 cSt at 40° C.

Once the viscosity has been adjusted, an additive package including between about 3–8 weight percent antioxidant, between about 1–4 weight percent extreme pressure/antiwear agents and a minor effective amount of a corrosion inhibitor are added. This yields a lubricant having a density at 15.6° C. of about 8.0 to 8.25 lbs./gal., a total acid number of about 0.01 to 0.15, a pour point of about −31° C. and a flash point of about 285° C. Generally, the lubricant composition will include between about 10 to 15 parts by weight of additive to 100 parts by weight of the desired polyol ester base stock.

Viscosity Index Improver/Tackifier: Polymethacrylate or polyacrylate copolymers, 90,000 to 150,000 molecular weight, applied at a level that strikes a balance between excessive drip and ease of application. These materials are generally available as 40 to 60 percent active in a mineral oil diluent.

The components of the additive package utilized in preparing the lubricant are as follows:

Antioxidants: These include phenolic, amine and methylenebis (dithiocarbamate) types or mixtures thereof Phenolic antioxidants may include various alkylated phenols, alkylated hydroxyphenolic ethers, polyalkylated bisphenol A and biphenol types, hydroxynaphthenes and alkylated thiophenols.

Amine antioxidants include alkylated diphenylamines, phenylenediamines, aldehyde and ketone amines, oligomeric aromatic amines and phenolic amines.

Methylene bis (dithiocarbamates) include N-substituted ($C_1$–$C_8$ alkyl) derivatives with the dibutyl compound preferred.

Extreme Pressure/Antiwear Agents: Organic phosphorus and sulfur compounds rather than metal -containing compositions are preferred for this application. These include methylene bis (dialkyl dithiocarbamates) and dialkyl dithiophosphate esters where the alkyls for these range from $C_1$ to $C_8$ as well as higher alkylated ($C_9$–$C_{12}$) triphenyl phosphorothionate or mixtures thereof Corrosion Inhibitor: These include certain heterocyclic nitrogen compounds such as benzothiazole, benzotriazole, tolyltriazole and aminotriazole or mixtures thereof.

The polyol ester base stock is the reaction product of a mixture of a polyol with a suitable mixture of monocarboxylic acids. In the preferred embodiments, the polyol is dipentaerythritol, but mixtures of pentaerythritol including a major proportion of dipentaerythritol are suitable. The dipentaerythritol polyol should include at least 50 weight percent dipentaerythritol. In the most preferred embodiment of the invention, the polyol is 100% commercially available dipentaerythritol. Such dipentaerythritol includes about 85% dipentaerythritol, about 5% monopentaerythritol and about 10% tri-and higher pentaerythritols The polyol ester base stock reaction product is formed by reacting the dipentaerythritol polyol with at least one monocarboxylic acid having from about 5 to 12 carbon atoms. It is desirable to obtain a polyol ester composition having an average molecular weight in the range of about 750 to 1250.

Monocarboxylic acids found particularly suitable for use include heptanoic ($C_7$) acid, caprylic/capric ($C_{8-10}$) acid and isononanoic (3, 5, 5-trimethylhexanoic) acid (iso-$C_9$). Preferred acid mixtures include between about 12–25 percent $C_7$ acid, between about 10–20 percent $C_{8-10}$ acid and the balance of between about 55–78 percent iso-$C_9$ acid. In addition to the average molecular weight, it is possible to vary the dipentaerythritol composition and the acid composition to provide an ester composition having a minimum viscosity at 40° C. of between about 100 to 125 cSt. The viscosity of the polyol ester at 100° C. should be between about 10 to 20 cSt and have a viscosity index in the range of about 100 to 125.

Preferably, the viscosity of the base stock is between about 240–300 cSt at 40° C. For the preferred base stock compositions having a viscosity at 40° C. of about 120–180 cSt, a viscosity index modifier is added to increase the viscosity to about 268 to 280 cSt. For the preferred polyol ester base stock, about 1–5 weight percent of polymethacrylate copolymer (excluding diluent) is added to increase the viscosity to between about 275–300 cSt.

It is well known in the art how to vary the content of a branched chain acid to increase the viscosity of the ester composition. For example, by reacting dipentaerythritol with 100% iso-$C_9$ acid, the resulting ester has a viscosity in excess of 300 cSt at 40° C. In this case, no viscosity modifier is needed to be added to the ester. However, experimentation has shown that this tends to lower the viscosity index to an undesirable level. Accordingly, it is preferred to include some linear acids in the reaction mixture.

When preparing a lubricant to operate at high temperatures, it is important that the lubricant not only provide the desired viscosity properties, but also provide improved thermal stability. Accordingly, incorporation of an additive package to improve the viscosity index and protect oxidation corrosion and boundary surface wear will result in a highly desirable lubricant. In addition, any polyol ester based lubricants must exhibit compatibility with materials it contacts, such as silicone rubber.

When preparing the polyol ester, the desired amount of polyol and carboxylic acid is placed into a reaction vessel. The carboxylic acid component is present in the reaction mixture in an excess of about 5 to 10 weight percent for the amount of polyol. The excess carboxylic acid is used to force the reaction to completion. The excess is not critical to carrying out the reaction, except that the smaller the excess, the longer the reaction time. After the esterification reaction is complete, the excess acid is removed by stripping and refining. Generally, the esterification reaction is carried out in the presence of a conventional catalyst. For example, tin, titanium, zirconium or tungsten-based catalysts designed for high temperature systems are suitable. Uncatalyzed esterification may also be carried out.

High temperature lubricant formulations are prepared by mixing a viscosity index improver, if necessary, and an additional additive package with the polyol ester product. The additive package includes antioxidants, extreme pressure and antiwear agents and a corrosion inhibitor. Additional additives such as an antifoam agent, detergents, hydrolytic stabilizers and metal deactivators may also be included.

The amount of viscosity index improver package admixed with the polyol ester base stock may vary up to about 20 weight percent. Depending upon the viscosity properties of the polyol esters and the desired physical and thermal properties of a resulting lubricant, one would vary the amount of viscosity index improver and additional additive package. It has been determined that a viscosity index modifier and typical additive package including antioxidants, extreme pressure and antiwear agents and a corrosion inhibitor can be added anywhere in amounts from of about 6 to 20 weight percent.

In a preferred embodiment of the invention, a polymer viscosity index improver, such as a polymethacrylate copolymer in a diluent may be present in amounts of polymer between about 1 to 5 weight percent; antioxidants and extreme pressure agents, such as an oligomeric aromatic amine, methylene bis (dibutyl dithiocarbamate) and 4,4-methylenebis (2,6-di-t-butylphenol) in amounts between about 3 to 8 weight percent; extreme pressure and antiwear agents, such as methylene bis (dibutyl dithiocarbamate) and nonylated triphenyl phosphorothionate in amounts between about 1 to 4 weight percent. A corrosion inhibitor, such as a benzotriazole may be added in minor amounts between about 0.01 to 0.05 weight percent.

After mixing the polyol ester base stock with the viscosity index improver and additive package, the lubricant should have a viscosity at 40° C. of between about 275 to 325 cSt. The viscosity at 100° C. should be between about 25 to 30 cSt. Preferably, the viscosity index is between about 110 to 140, the pour point is below about −25° C. and the flash point is in excess of about 260° C.

The invention will be better understood with reference to the following examples. All percentages are set forth in percentages by weight, except where molar quantities are indicated. These examples are presented for purposes of illustration only, and are not intended to be construed in a limiting sense.

EXAMPLE 1

A dipentaerythritol ester was prepared in a reaction vessel equipped with a mechanical stirrer, thermocouple, thermoregulator, Dean-Stark trap, condenser, nitrogen sparge and vacuum source. The following materials were charged to the reactor:

| INGREDIENT | AMOUNT gms (moles) |
|---|---|
| Dipentaerythritol | 1225 g (4.8 m) |
| Heptanoic acid | 750 g (5.77 m) |
| Caprylic/capric acid (acid no. 361.5) | 750 g (4.83 m) |
| Isononanoic acid | 3500 g (22.15 m) |

The reaction mixture was heated to 185°–190° C. with agitation. The water-of-reaction was collected in and removed from the Dean-Stark trap. The temperature was gradually raised over 5–6 hours to about 230° C. with application of vacuum to maintain reflux. This removed the reaction water and returned the acid collected in the trap to the reactor. These conditions were maintained to a point where the hydroxyl number of the reaction mixture was less than 3.0. The bulk of the excess acid was then removed by vacuum distillation together with nitrogen sparge and then residual acidity was removed with alkali.

The resulting product was dried and filtered to obtain 5100 g of polyol ester product having the following properties.

Viscosity, cSt
@ 100° C.: 17.5
@ 40° C.: 173
Viscosity Index: 113
Pour Point, ° C.: −29
Flash Point, C.O.C., ° C.: 285
Fire Point, C.O.C., ° C.: 310
Total Acid No., mgKOH/g: 0.01
Water Content, ppm: 200
Hydroxyl No., mgKOH/g: 2.0
Specific Gravity, 25/25° C.: 0.970
Evaporation Loss, %
@ 204° C./6.5 hours: 2.0
@ 250° C./1.0 hour: 2.0
4-Ball Wear @ 75° C./1 hour, 1200 rpm, 40 kg; mm: 0.86

EXAMPLE 2

A high temperature lubricant composition was formulated as follows.

| COMPONENT | PARTS BY WEIGHT |
|---|---|
| Polyol ester of Example 1 | 100 |
| Viscosity index improver | 5.6 (2.8% polymer) |
| Antioxidant | 4.5 |
| Extreme pressure and antiwear agents | 2.25 |
| Corrosion inhibitor | 0.03 |

The resulting lubricant composition had a viscosity at 40° C. of about 298 cSt and at 100° C. of about 28 cSt. The viscosity index was about 126.

EXAMPLE 3

In order for a lubricant composition to be acceptable in the high temperature applications, it must have low volatility and not form deposits or varnish when exposed to high temperatures for extended periods of time. To test the high temperature volatility of the lubricant, a sample of lubricant was maintained in an oven at high temperature for an extended period of time and the weight loss was measured periodically.

In this test, 11 grams of lubricant was placed in a petri dish having an internal diameter of 90 mm. The petri dish was placed in a ventilated oven at 230° C. The petri dish was weight after 2, 4, 8, 24, 48, 72 and 80 hours. This gave sufficient data points to plot the weight loss percentage vs. time.

During each weighing, the physical characteristic of the lubricant in the petri dish was observed. The ideal lubricant would not form deposits and would maintain a liquid flowable form and exhibit at 2 hours less than 6% weight loss, at 24 hours less than 25% weight loss, at 48 hours less than 35% weight loss and at 80 hours less than 40% weight loss. The test may also be continued to 168 hours.

The lubricant in Example 2 was tested in the oven evaporation test. The results are as follows:

| Time Oven at 230° C. (hours) | Weight Loss (%) |
|---|---|
| 24 | 8.3 |
| 72 | 14.4 |
| 80 | 15.6 |
| 96 | 18.7 |
| 120 | 23.2 |
| 144 | 28.6 |
| 168 | 36.9 (still liquid, no deposits) |

EXAMPLE 4

The polyol ester high temperature lubricant prepared following the procedures of Example 2 was compared to a chain oil lubricant described in U.S. Pat. No. 5,151,205. The lubricant of Example 1, composition 2, of the patent was selected. The lubricant is described as having the following composition.

| Lubricant #2 | Wt. % | Component Description |
|---|---|---|
| Base Oil | 75.2 | PAO |
| TMP Ester 1 | 20 | TMP ester of $C_8$–$C_{10}$ normal carboxylic acids |
| Tackifier | 3.0 | IDATAC M-256, polybutene polymer of 500,000 to 1,000,000 molecular weight |
| Gear Oil Additive | 1.5 | Unidentified* |
| Antioxidant 1 | 0.3 | Ethylalphamethylstyrenated phenylamine |

*The gear oil additive was not specifically identified. Accordingly, in order to replicate this Example, two hand-blended samples were prepared. Both included 75.2 weight percent polyalphaolefin base oils. A gear oil additive available from Ciba, known as Irganox ML 811 was added in the amount 1.5 weight percent.

The compositions of the hand blended samples were as follows:

| | Hand-blended samples for oven test | |
|---|---|---|
| Equivalent Lubricant | A | B |
| PAO 8** | 15.04 | 18.8 |
| PAO100 | 60.16 | 56.4 |
| TMP Ester of $C_{8-10}$ normal carboxylic acid | 20 | 20 |
| Amoco Indopol H-100-average molecular weight = 920 | 3 | 3 |
| Ciba-Irganox ML 811 gear oil additive | 1.5 | 1.5 |
| Octylated/Stryrenated diphenylamine (liquid) | 0.3 | 0.3 |

**The PAO oil was formulated from two available oils to yield a base oil comparable in viscosity to the lubricant of composition #2.

When these hand-blended polyalphaolefin based samples A and B were subjected to the oven evaporation test, the following results were obtained:

| | A | B |
|---|---|---|
| Oven Evaporation @230° C. after 24 hours: | 31.8 | 35.6 |
| 72 hours | 46.8 | 50 |
| 80 hours | 48.34* | 51.1* |

-continued

| | A | B |
|---|---|---|
| 96 hours | 50.7 | 52.8 |
| 120 hours | 52.92** | 54.1** |
| 144 hours | 55.44 | 56.6 |
| 168 hours | 57.2 | 59.0 |

*Point where sample turned solid/deposits/black
**At 120 hours both samples were cracking into pieces

EXAMPLE 5

In this bench panel test, a stainless steel panel is electrically heated by means of two heaters which are inserted into holes in the panel. The temperature is monitored by means of a thermocouple. The panel is placed on a slight incline and heated to 540° F. The lubricant to be tested is dropped onto the heated panel and the characteristics are observed. The lubricant contacts the panel near the top of the incline and is observed as a central dark band. The lubricant then tends to thin out as it travels towards the pointed end of the heated panel. It is along the oil-air-metal interface that the degradation of the lubricant is best observed.

The results of the panel test for a composition prepared in accordance with the composition of Example 2 showed almost no degradation along the oil-air-metal interface. This lubricant is a polyol ester mixture formed by reacting dipentaerythritol with a carboxylic acid mixture including heptanoic, capric-caprylic and iso-nonanoic acids.

The panel test results for a polyalphaolefin based lubricant of Example 4 showed severe carbonization along the oil-air-metal interface as well as over the entire oil wetted area of the panel.

It will thus be seen that the objects set forth above, among those made apparent from the preceding description, are efficiently attained and, since certain changes may be made in the above composition of matter without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A synthetic polyol ester based lubricant, comprising (A) a polyol ester base stock that is the reaction product of:

(i) a polyol mixture including a major proportion of dipentaerythritol, and (ii) a mixture of $C_5$ to $C_{12}$ monocarboxylic acids, said mixture including:

(a) from about 25–50 weight percent of linear $C_7$ to $C_{8-10}$ acids, and (b) from about 50–75 weight percent iso-$C_9$ acid;

wherein the resulting mixture of esters has a viscosity at 40° C. of at least about 120 cSt,;

(B) a viscosity index improver effective to increase the viscosity of the base stock at 40° C. to about 240 to 300 cSt; and (C) an additive package including, between about 3–8 weight percent antioxidant, between about 1–4 weight percent extreme pressure/anti-wear agents and a minor effective amount of a corrosion inhibitor;

to yield a lubricant having a density at 15.6° F. of about 8.0 to 8.25 lbs./gal., a total acid number of about 0.01 to 0.15, a pour point of about −31° C. and a flash point of about 285° C. and a viscosity at 40° C. of about 270 to 330 cSt.

2. The synthetic lubricant of claim 1, wherein the polyol mixture is about 85 weight percent dipentaerythritol.

3. The synthetic lubricant of claim 1, wherein the carboxylic acid mixture includes about 15 to 20 weight percent $C_7$ acid, 65 to 70 weight percent iso-$C_9$ acid and 12 to 18 weight percent $C_{8-10}$ acid.

4. The synthetic lubricant of claim 1, wherein the viscosity index improver is at least one member selected from the group consisting of polymethacrylate and polyacrylate copolymers and mixtures thereof.

5. The synthetic lubricant of claim 1, wherein the viscosity index improver is a polyrnethacrylate copolymer, including between about 1 to 5 weight percent polymer, exclusive of carrier.

6. The synthetic lubricant of claim 1, wherein the antioxidant in the additive package is at least one member selected from the group consisting of phenolic, amine and methylene bis (dithiocarbamates) and mixtures thereof.

7. The synthetic lubricant of claim 1, wherein the extreme pressure/anti-wear agents include at least one member selected from the group consisting of organic phosphorus and sulfur compounds and mixtures thereof.

8. The synthetic lubricant of claim 1, wherein the corrosion inhibitor is at least one heterocyclic nitrogen compounds.

9. The synthetic lubricant of claim 6, wherein the antioxidant includes at least an oligomeric aromatic amine, methylene bis(dibutyl dithiocarbamate) and 4, 4'-methylene bis (2,6-di-t-butyl phenol).

10. The synthetic lubricant of claim 7, wherein the extreme pressure agent is at least one of nonylated triphenyl phosphorothionate and dialkyl dithiophosphate ester.

11. The synthetic lubricant of claim 8, wherein the corrosion inhibitor is a triazole.

12. The synthetic lubricant of claim 11, wherein the triazole is benzotriazole.

13. The synthetic lubricant of claim 4, wherein viscosity index improver is at least one polymethacrylate copolymer.

* * * * *